US008355264B2

(12) United States Patent
Hur et al.

(10) Patent No.: US 8,355,264 B2
(45) Date of Patent: Jan. 15, 2013

(54) MOUNTING PLATE FOR A NOTIFICATION APPLIANCE

(75) Inventors: Inhong Hur, Oakhurst, NJ (US); Luy Nguyen, Colts Neck, NJ (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/235,923

(22) Filed: Sep. 19, 2011

(65) Prior Publication Data

US 2012/0007746 A1 Jan. 12, 2012

Related U.S. Application Data

(63) Continuation of application No. 12/897,632, filed on Oct. 4, 2010, now Pat. No. 8,023,286, which is a continuation of application No. 12/265,438, filed on Nov. 5, 2008, now Pat. No. 7,817,443, which is a continuation of application No. 11/543,358, filed on Oct. 5, 2006, now Pat. No. 7,450,026.

(51) Int. Cl.
*G08B 23/00* (2006.01)
*H01R 9/00* (2006.01)

(52) U.S. Cl. ..... 361/822; 337/343; 340/693.9

(58) Field of Classification Search ..... 361/822
See application file for complete search history.

(56) References Cited

U.S. PATENT DOCUMENTS 3,573,410 A * 4/1971 Budzich et al. ..... 200/83 P
3,826,116 A 7/1974 Messera et al.
3,943,480 A * 3/1976 Schmitt ..... 337/371
4,276,531 A * 6/1981 Davis ..... 337/407
4,284,314 A 8/1981 Lesyk
4,451,814 A * 5/1984 Barry et al. ..... 337/407
4,550,358 A * 10/1985 Crowley et al. ..... 361/42
4,851,807 A * 7/1989 Holden et al. ..... 337/343
5,486,816 A 1/1996 Ariga et al.
5,684,467 A 11/1997 Hur
5,710,541 A 1/1998 Stanley et al.
5,805,071 A 9/1998 Hur
6,271,763 B1 8/2001 Hur
6,402,570 B2 6/2002 Soga et al.
6,522,261 B2 2/2003 Scheffler et al.
7,019,420 B2 3/2006 Kogan et al.
7,071,809 B2 * 7/2006 Davis et al. ..... 337/356
7,336,165 B2 2/2008 Fuchs
7,375,617 B2 * 5/2008 Stirling ..... 340/384.1
7,450,026 B2 * 11/2008 Hur et al. ..... 340/693.9
7,637,527 B2 * 12/2009 Mazanek et al. ..... 280/728.2
7,817,443 B2 * 10/2010 Hur et al. ..... 361/822
8,023,286 B2 * 9/2011 Hur et al. ..... 361/822

OTHER PUBLICATIONS

International Search Report and Written Opinion for PCT/US2007/079750, Apr. 8, 2008, consists of 11 unnumbered pages.
International Preliminary Report on Patentability for PCT/US2007/079750, Apr. 16, 2009, consists of 8 unnumbered pages.

* cited by examiner

*Primary Examiner* — Michael Zarroli

(57) ABSTRACT

A mounting plate assembly for a notification appliance is disclosed. For example, a mounting plate is designed with at least one aperture for receiving a plurality of leads, e.g., from a backbox. In turn, these leads can be received by a plurality of contacts that are deployed on the mounting plate. In one embodiment, at least two of these contacts are in physical contact with each other at a juncture, thereby providing connectivity between these two contacts. However, the physical contact at the juncture is non-resettable, i.e., if a force is applied to the juncture, then the connectivity is severed and the physical contact between the two contacts cannot be easily re-established even if the force is removed.

20 Claims, 7 Drawing Sheets

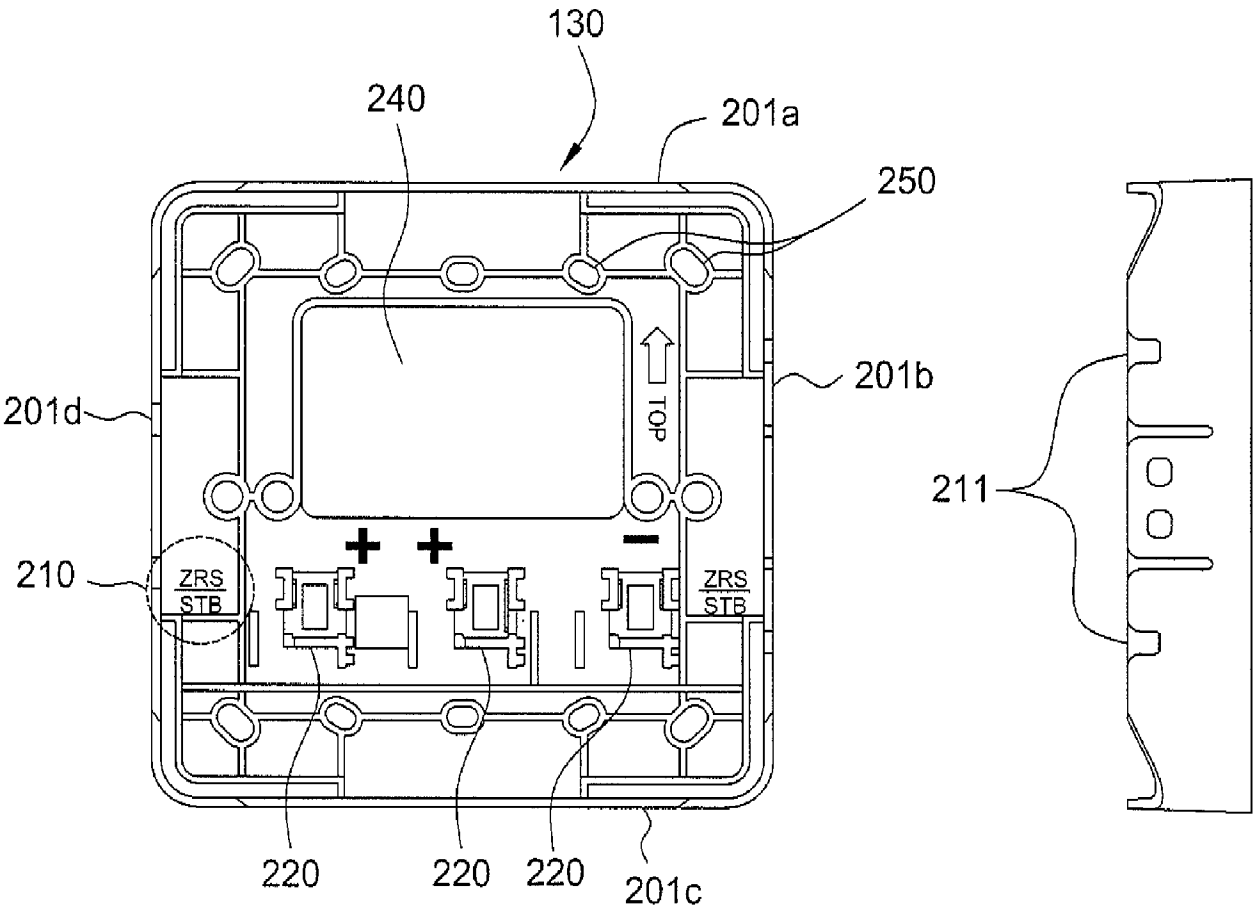
FIG. 2A
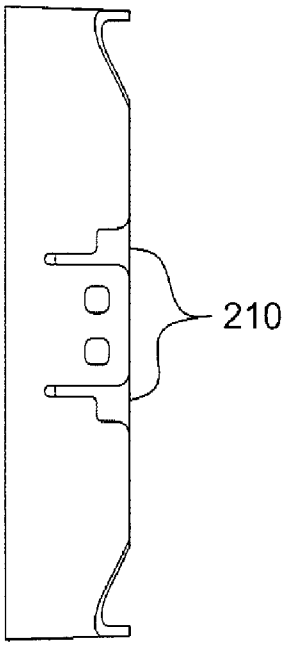
FIG. 2B
FIG. 2C

MOUNTING PLATE FOR A NOTIFICATION APPLIANCE

CROSS REFERENCE TO RELATED APPLICATIONS

This application is a continuation of U.S. patent application Ser. No. 12/897,632, filed Oct. 4, 2010, which is in turn a continuation of U.S. patent application Ser. No. 12/265,438, filed Nov. 5, 2008 (now U.S. Pat. No. 7,817,443), which is in turn a continuation of U.S. patent application Ser. No. 11/543,358, filed Oct. 5, 2006 (now U.S. Pat. No. 7,450,026). All of these applications are incorporated by reference in their entireties.

FIELD OF THE INVENTION

The present invention relates generally to the field of notification appliances, e.g., an audible alarm, a visible alarm, and/or an audible-visual alarm and, more specifically, to a mounting plate for mounting such notification appliances in multiple mounting configurations.

BACKGROUND OF THE DISCLOSURE

Notification appliances are widely used in fire alarm systems, emergency warning systems, facility monitoring systems, and the like. As used herein, the term notification appliance refers to a device which generates an audible alarm (e.g., a horn, a bell, a siren, a buzzer, etc), a visual alarm (e.g., a strobe or a flash), or both. Typically, such notification appliances are attached to an electrical backbox, which in turn is mounted on a wall or ceiling surface (surface mounted or wire mold mounted) or embedded in the wall. Electrical leads or wires extend into the backbox through knock-outs in the rear or sides of the backbox. The audible and/or visual alarm generating elements, e.g., an acoustic transducer and/or an electronic strobe or LED, are usually mounted on the notification appliance, with electric leads leading rearwardly into the backbox. An intermediate mounting or adapter plate is sometimes used to attach the notification appliance to the backbox.

In many deployment scenarios, a plurality of notification appliances is usually daisy-chained together to form a circuit or a loop of notification appliances. In turn, this circuit of notification appliances is in communication with an alarm or control panel that monitors the status of the notification appliances and causes the notification appliances to be triggered during an emergency situation.

As such, each notification appliance may have at least two leads and, at times, up to eight leads that will need to be connected to the circuitry of the notification appliance. Since it is necessary to provide a certain amount of slack in connecting the numerous leads to the circuitry of the notification appliance (e.g., connecting the leads to one or more screws on a terminal block of the notification appliance circuitry), there is often a substantial length of leads that must be careful stowed within the backbox. However, given the gauge of the leads, the bundle of leads are often quite stiff. As such, as the notification appliance is pushed toward the mounting plate during installation in the field, it is possible that one or more leads may disengage from its terminal or one or more leads may create a short. Unfortunately, such errors would not be easily detected until the entire loop of notification appliances is deployed. For example, an installer will perform a continuity test at the panel for the entire loop of notification appliances, where the installer may detect an open condition or a short condition. Although such erroneous condition can be detected, the installer does not have the ability pinpoint exactly the location, i.e., which notification appliance, is causing the error. As such, it is necessary for the field installer to check all the notification appliances in the pertinent loop. This is extremely time consuming and impractical, especially if the loop contains a large number of notification appliances.

Therefore, there is a need for a mounting plate having a configuration that will increase the ease of installation and also allows a continuity test to be performed for a circuit of notification appliances.

SUMMARY OF THE INVENTION

In one embodiment, the present invention discloses a mounting plate assembly for a notification appliance. For example, the mounting plate is designed with at least one aperture for receiving a plurality of leads, e.g., from a backbox. In turn, these leads can be received by a plurality of contacts that are deployed on the mounting plate. In one embodiment, at least two of these contacts are in physical contact with each other at a juncture, thereby providing connectivity between these two contacts. However, the physical contact at the juncture is non-resettable, i.e., if a force is applied to the juncture, then the connectivity is severed and the physical contact between the two contacts cannot be easily re-established even if the force is removed. In one illustrative embodiment, a push rod located on a notification appliance is used to impact the juncture when the notification appliance is attached to the mounting plate. The push rod effectively causes a deformation on an extension section of one of the contacts at the juncture, thereby severing the connectivity. In one embodiment, the extension section of one of the contacts is designed with at least one perforation such that the applied force causes the extension section to deform in such a manner that it is unable to return to its original state even when the force is withdrawn. This novel mounting plate configuration allows a connectivity test to be performed without having to install all the notification appliances on a circuit.

BRIEF DESCRIPTION OF THE DRAWINGS

The teachings of the present invention can be readily understood by considering the following detailed description in conjunction with the accompanying drawings, in which:

FIGS. 2A-2C illustrate the mounting plate of the present invention;

To facilitate understanding, identical reference numerals have been used, where possible, to designate identical elements that are common to the figures.

DETAILED DESCRIPTION

Figure 1:
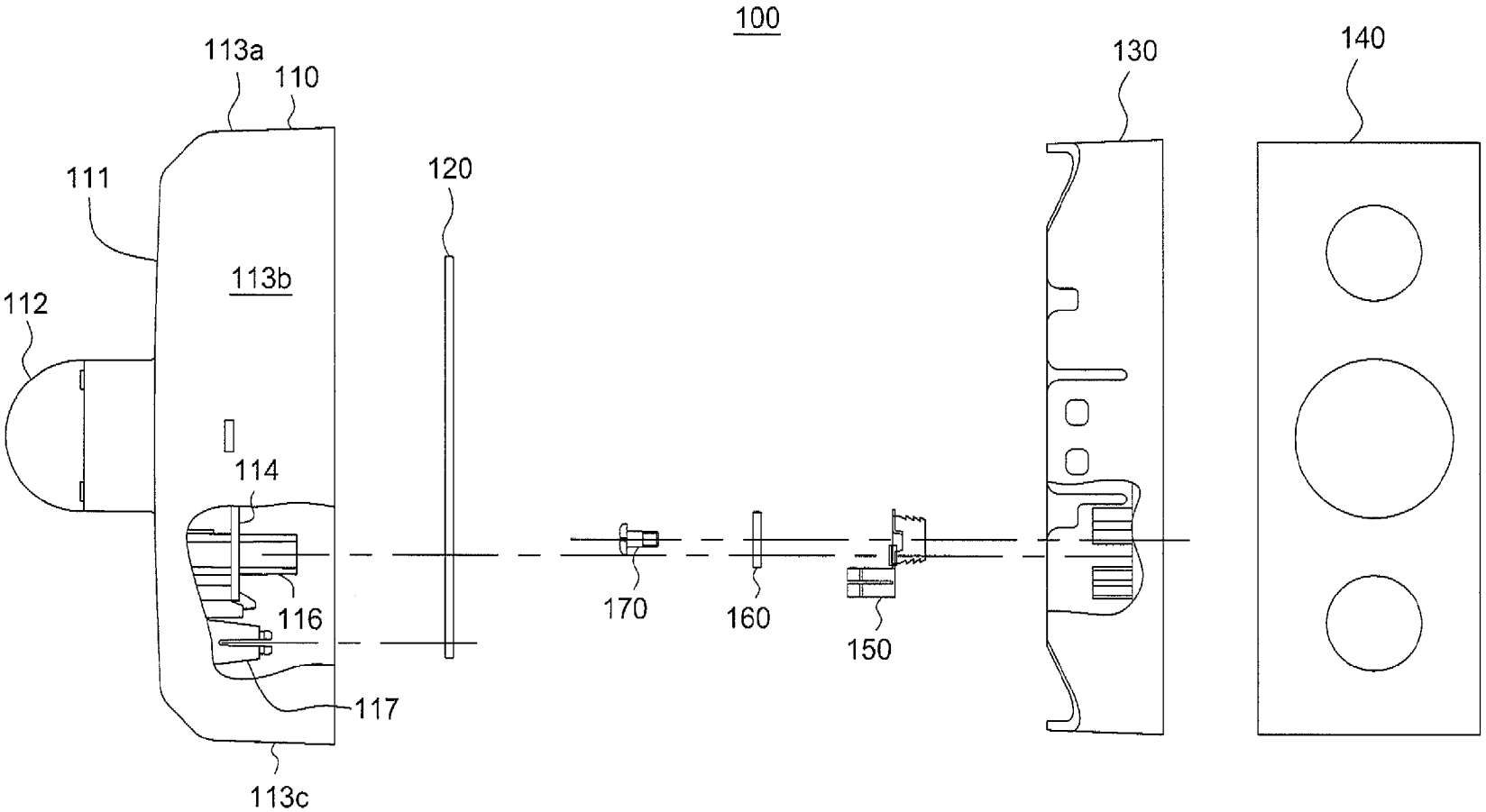
FIG. 1 illustrates a cut away side view of a notification appliance assembly of the present invention.
Figure 7:
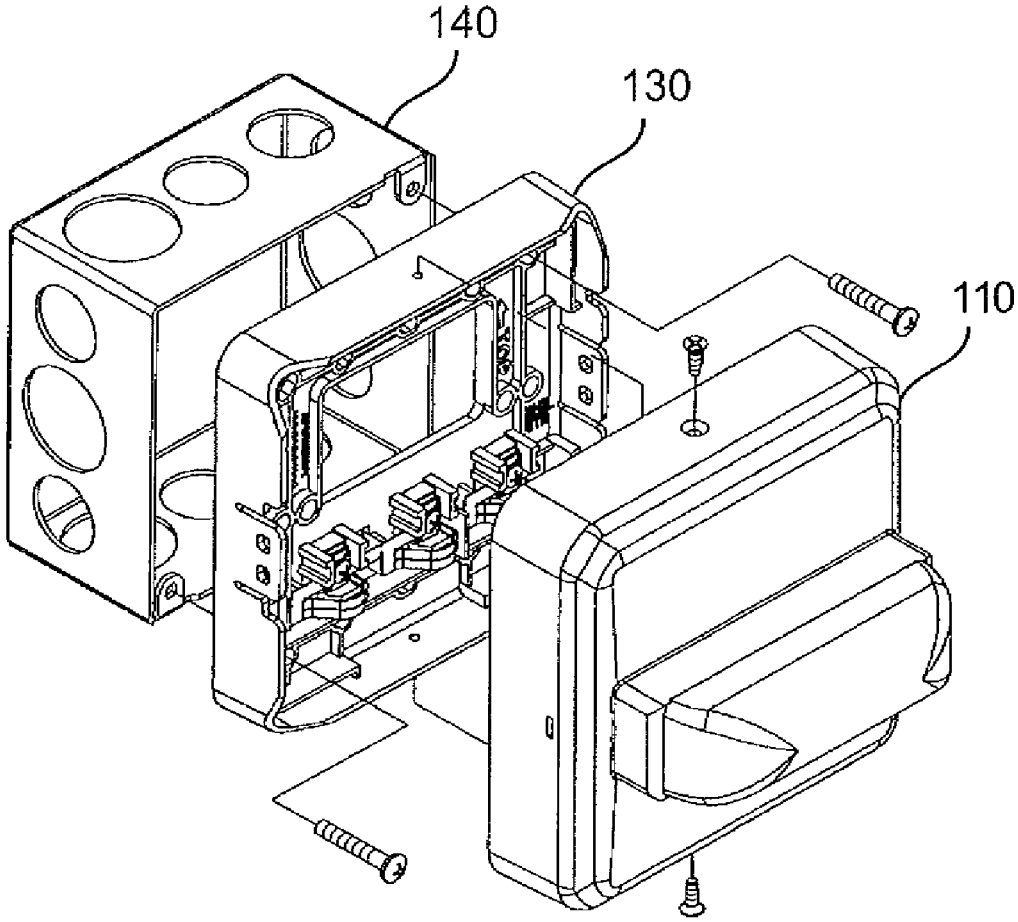
FIG. 7 illustrates an isometric view of the notification appliance assembly of the present invention.

FIG. 1 illustrates a cut away side view of an illustrative notification appliance assembly 100 of the present invention. An isometric view of the illustrative notification appliance assembly 100 is also provided in FIG. 7. In one embodiment, the notification appliance assembly 100 comprises a notification appliance 110, a printed circuit board insulator 120, a mounting plate 130 and a backbox 140.

In one embodiment, the notification appliance 110 is secured to the mounting plate 130 by one or more fasteners, and the mounting plate 130 is in turn secured to the backbox 140 by one or more fasteners. For simplicity and ease of installation, fasteners such as self-tapping screws, locking tabs, and/or bolts can be used to attach the mounting plate 130 to the backbox 140. Similarly, fasteners such as self-tapping screws, locking tabs, and/or bolts can be used to attach the notification appliance 110 to the mounting plate 130. The selection of a particular type of fastener can be deployed in accordance with the requirement of a particular application. The present invention is not limited by the type of fasteners that are used to secure the notification appliance 110, the mounting plate 130 and the backbox 140 together.

One aspect of the present invention is that the mounting plate 130 enables the notification appliance 110 to be attached to various standard backboxes, including the single-gang box, the double-gang box (either surface mounted or wire mold mounted), the 4-inch box and the international (100 mm) box. By way of illustration, FIG. 1 depicts a 4-inch backbox (4 inches square). However, the present invention is not limited to a square backbox. Namely, the present invention can be adapted to a mounting plate that can be deployed with backboxes of various shapes, e.g., an octagon-shaped backbox (e.g., 4-inch octal backbox, or 3.5-inch octal backbox) and the like.

When attached to a wall, the notification appliance assembly 100 may be surface mounted, in which case the backbox 140 is attached directly to the wall surface, flush mounted, in which case the backbox 140 is recessed within the wall and the back edge of the notification appliance 110 abuts the wall surface, or semi-flush mounted, in which case the backbox is recessed as before but an extender is inserted between the backbox and the back edge of the notification appliance 110 to offset it from the wall surface by a desired distance. If an extender were employed with the assembly of FIG. 1, it would be located between the mounting plate 130 and the backbox 140 and secured thereto by one or more fasteners. Alternatively, the backbox may be wire mold mounted.

In one embodiment, the notification appliance 110 is square in outline, having a front wall 111 and four perimeter side walls (e.g., 113*a*-113*c* are shown on FIG. 1). The side wall length is somewhat larger than the largest backbox to be fitted, in this example the 4-inch backbox. The front-to-back depth of each sidewall is sufficient to accommodate receipt of the audible and/or visual circuitry (e.g., shown as a circuit board 114), within the notification appliance 110. In a typical audible-visual notification appliance, the audible alarm may include a piezoelectric transducer and associated electronics and the visual alarm may include a strobe lamp or one or more light emitting diodes (LEDs) and associated electronics. The strobe lamp typically would include a flash tube and a reflector (not shown) that are encased within a strobe lens 112.

In one embodiment, a transparent or translucent strobe lens 112 is mounted on the front wall 111, overlying a front-to-back opening (not shown) in the wall 111 for receipt of the strobe lamp and associated components of the notification appliance. For ease of assembly, the strobe lens 112 snap-fits within the opening. In the alarm orientation depicted in FIG. 1, the strobe lamp and lens 112 are oriented in a horizontal direction. They may alternatively be oriented in the vertical direction.

As shown generally in FIG. 1 and in more detail in FIGS. 2A-2C and 5, the mounting plate 130 is substantially square in outline, and is slightly smaller in size than the open back side of the notification appliance 110 so as to fit snugly therewithin and substantially close the back side thereof. In one embodiment, a printed circuit board insulator 120 is deployed between the open back side of the notification appliance 110 and the mounting plate 130. The printed circuit board insulator 120 is held in place by a plurality of posts 117 (only one is shown in FIG. 1) directly behind the circuit board 114. The printed circuit board insulator 120 is made from a non-conductive material, e.g., a plastic material and the like. The printed circuit board insulator 120 is intended to protect the circuit board 114 from leads or wires that are terminating on the mounting plate 130.

In one embodiment, the present mounting plate 130 employs a plurality of conductive contacts 150 for receiving leads that are received through the backbox 140. For example, the leads (not shown) can be secured to the mounting plate 130 via a washer 160 and a fastener 170. In one embodiment, the conductive contacts 150 are made from a metal material and designed to be spring loaded.

Thus, the conductive contacts 150 allow the leads to terminate at the mounting plate 130. As will be further described below, this useful feature allows a connectivity test to be performed on a circuit of notification appliances without having to install the notification appliances 110 and their associated circuitry onto their respective mounting plate 130. Furthermore, the conductive contacts 150 are configured in a manner that will allow a push rod 116 located on the notification appliance 110 to alter the connectivity of the contacts 150 when the notification appliance 110 is installed onto the mounting plate 130. In brief, the contacts 150 are initially in physical contact with each other for the purpose of supporting a connectivity test. However, once the notification appliance 110 is installed, the physical contact between the contacts 150 is severed and connectivity is replaced by the circuitry located on the notification appliance 110. This novel feature will be further described below.

FIGS. 2A-2C illustrate the mounting plate 130 of the present invention. Specifically, FIG. 2A illustrates a front view of the mounting plate 130 and FIGS. 2B and 2C illustrate the two side views of the mounting plate 130.

In one embodiment, the mounting plate 130 contains a plurality of apertures 250 along all four sides 201*a*-201*d*. These apertures allow the mounting plate 130 to be used with various backboxes. As such, one universal mounting plate 130 can be used with various different backboxes. Thus, an installer may use the present mounting plate 130 in the field irrespective of the backboxes that are currently deployed. This compatibility with various backboxes increases ease of installation and simplifies the ordering of mounting plates for a particular installation project.

The mounting plate 130 further contains a plurality of contact bases 220, which are deployed to receive conductive contacts 150. In this illustrative embodiment, only three contact bases 220 are shown, where two of the contact bases 220 are designated as positive (+) and one contact base 220 is designated as negative (−). It should be noted that any number of contact bases can be deployed. In one embodiment, leads or wires are received through an aperture 240 of the mounting plate 130. These leads are received through the backboxes. Unlike conventional notification appliances where the leads are directly coupled to terminals located on the notification appliance, the leads are coupled to the mounting plate 130 of the present invention instead. In one embodiment, the leads are coupled to conductive contacts 150 seated in the contact bases 220 of the mounting plate 130 (See FIG. 5 below for more detail).

In one embodiment, contacts 150 situated in the two "positive" contact bases 220 are deployed in a manner such that the two contacts 150 are physically touching each other. This contact arrangement allows connectivity tests to be performed without the need to fully install all the notification appliances of a particular circuit. In other words, from the perspective of the alarm or control panel, the mounting plates with the leads coupled to the contacts 150 would appear that all the notification appliances of a circuit have been installed. This novel approach allows the leads to be coupled directly to the mounting plate such that a connectivity test can be performed to verify the continuity of the circuit even if the notification appliances have yet to be deployed. Furthermore, the connectivity test can be performed in a manner where the mounting plate is not yet covered by the notification appliance 110. As such, inspection of the connectivity of the leads to the contacts 150 can be easily made.

Furthermore, the arrangement of the contacts 150 on the contact bases 220 provides an additional advantage where upon installation of the notification appliance 110, the connectivity of the contacts situated in the two "positive" bases 220 will be broken. This is necessary because once the notification appliance 110 is installed, the connectivity between the contacts 150 will be replaced by the circuitry located on the notification appliance 110. As such, the physical contact between the contacts 150 is intended only to be temporary for the sole purpose of allowing a connectivity test to be performed.

In one embodiment, the mounting plate 130 employs one or more markings 230 (e.g., a line with alphanumeric characters) to present the relative position of a visible alarm element, e.g., a strobe or a LED. Within certain jurisdictions, there may be regulatory requirements that dictate the height in which the visible alarm element must be deployed relative to the floor, e.g., the strobe element must be 80 inches high from the floor. However, since the backboxes are often installed first before the notification appliance is attached, an installer may install the backboxes at an improper height, thereby creating delay if the backboxes have to be readjusted to the proper height. As such, to assist the installer, the mounting plate is provided with at least one marking 230 to indicate the height of the strobe element when the notification appliance 110 is engaged with the mounting plate 130. In order words, the installer can simply measure from the floor to the marking 230 to ensure that regulatory requirements will be met, e.g., measuring 80 inches from the floor to the marking 230. There is no need to physically acquire the notification appliance 110 to make this measurement. Namely, the position of the marking 230 is calibrated such that when the notification appliance is engaged with the mounting plate 130, the visible alarm element will be located at the position represented by the marking 230. Thus, the marking 230 provides an efficient way to guide the proper installation of backboxes at the proper height, thereby increasing the efficiency of the installation process.

Furthermore, in one embodiment, the mounting plate 130 incorporates keys 210 and keys 211. These keys are deployed in a manner that will assist in the installation of the notification appliance 110 to the mounting plate 130. For example, keys 210 are deployed on one side of the mounting plate 130, while keys 211 are deployed on another side of the mounting plate 130. These keys will engage corresponding tabs 610 and 611 located on the notification appliance 110 (See FIG. 6). In one embodiment, the distance separating keys 210 are different than the distance separating keys 211. As such, this configuration will only allow the notification appliance 110 to be coupled to the mounting plate 130 in a particular orientation. It should be noted that since the notification appliance 110 is generally square, an installer may erroneous install the notification appliance 110 in an improper orientation if guiding keys are not provided. Thus, it is very useful to an installer that the keys 210 and 211 will only allow one particular orientation so that the notification appliance 110 cannot be improper installed on the mounting plate.

Figure 3A:
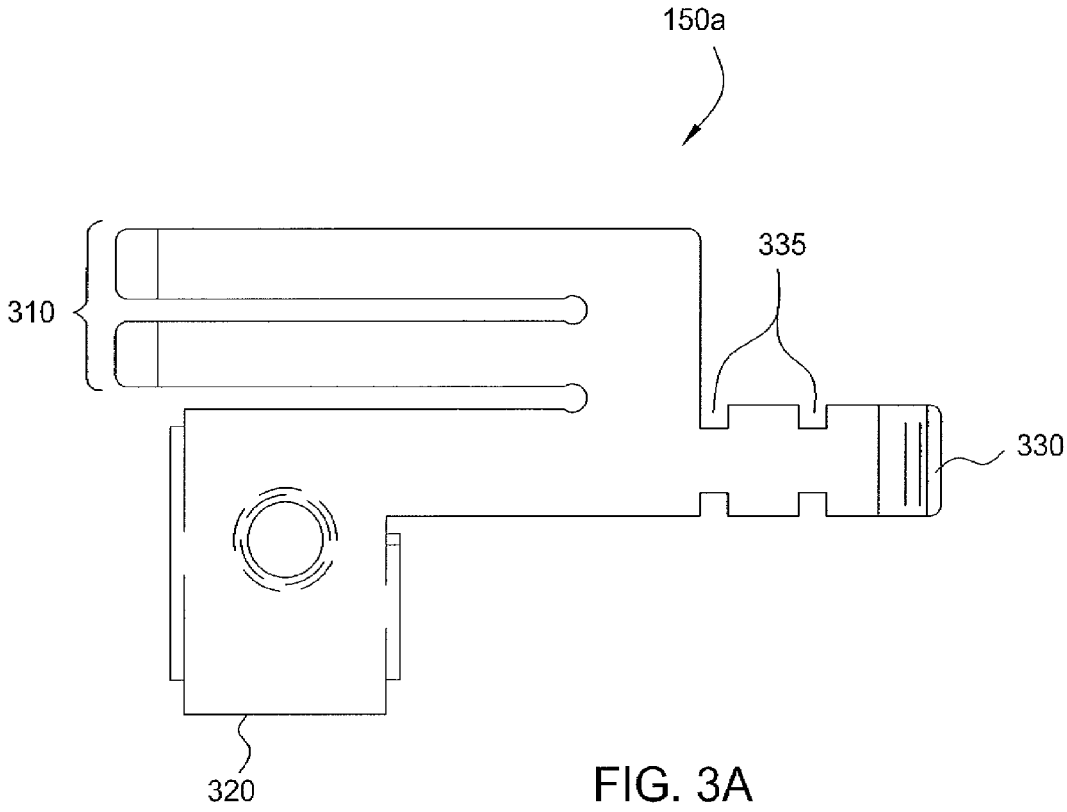
FIGS. 3A-3B illustrate one embodiment of a contact of the present invention.
Figure 3B:
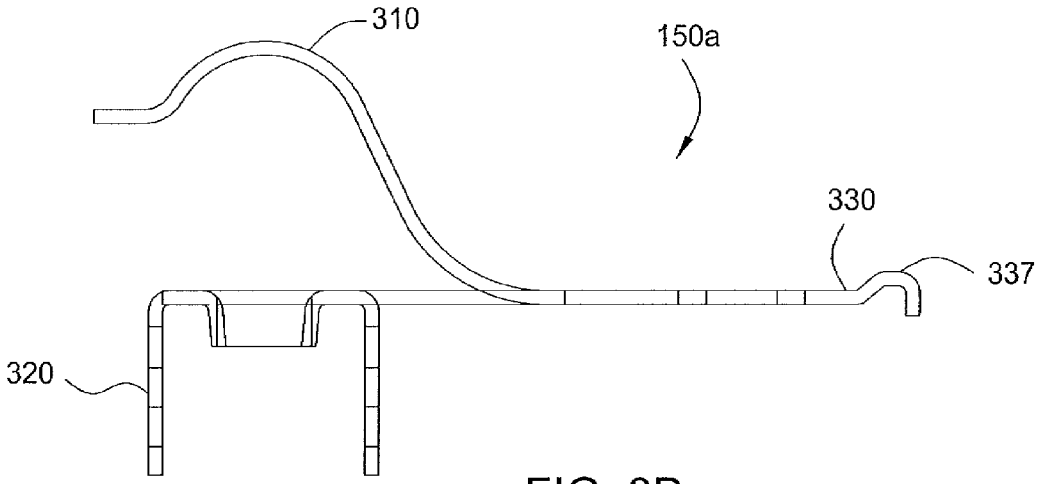

FIGS. 3A-3B illustrate one embodiment of a contact 150*a* of the present invention. Specifically, FIG. 3A illustrates a front view of contact 150*a* and FIG. 3B illustrates a side view of contact 150*a*. In one embodiment, contact 150*a* comprises a spring loaded portion 310, a base portion 320, and an extension portion 330. In one embodiment, the extension portion 330 comprises one or more perforated sections 335 and a curved end 337. In operation, the base portion 320 of contact 150*a* is used to seat and to secure the contact 150*a* into the base 220 of the mounting plate 130. The spring loaded portion 310 is used to make contact with a conductive contact located on the circuit board 114 of the notification appliance 110. The extension portion 330 is used to make contact with an adjacent contact 150*b* (as shown in FIG. 4). In one embodiment, extension portion 330 contains a curved end 337 for ensuring proper contact with an adjacent contact 150*b*.

In one embodiment, extension portion 330 contains one or more perforated sections 335. The purpose of these perforated sections 335 is to allow the extension portion 330 to be impacted to sever the physical contact between contact 150*a* and contact 150*b* as further described below. The perforated sections 335 allow the extension portion 330 to be easily deformed and they also ensure that once deformed, the extension portion 330 cannot be easily returned to its original state. In other words, the contact 150*a* is not easily resettable once it is deformed beyond a certain point. The reason for this non-resettable feature is that although contacts 105*a* and 105*b* are initially deployed in the mounting plate 130 in a conductive state (i.e., in physical contact with each other) for the purpose of supporting a connectivity test, this physical contact must be subsequently severed once the notification appliance 110 is installed on the mounting plate 130. Namely, the circuitry on the notification appliance 110 will now replace the connectivity between the contacts 150*a* and 150*b*. However, if the notification appliance is subsequently removed from the mounting plate 130, it is important that the alarm or control panel is able to detect this loss of one of the notification appliances from the circuit. However, if the contact 150*a* is resettable, then one can simply recouple contact 105*a* with contact 150*b* again after the notification appliance is removed. This can possibly lead to a misleading and potentially dangerous situation, where the alarm or control panel is unable to detect the loss of one or more notification appliances in a circuit, e.g., due to vandalism, due to maintenance operations and the like. Thus, in one embodiment, it is desirable that the extension portion 330 cannot be easily returned to its original state once it has been deformed beyond a certain point.

In one embodiment, extension portion 330 can be deployed as a different type of metal, e.g., a softer metal when compared to the material used to form other portions of the contact. For example, the contact 150*a* may utilize stainless steel to form spring loaded portion 310 and base portion 320, whereas copper is used to form the extension portion 330.

This alternate embodiment will achieve the non-resettable feature of the contact by ensuring that the softer extension portion 330 will not be able to return to its original form once a force is applied to deform the extension portion 330.

Figure 4A:
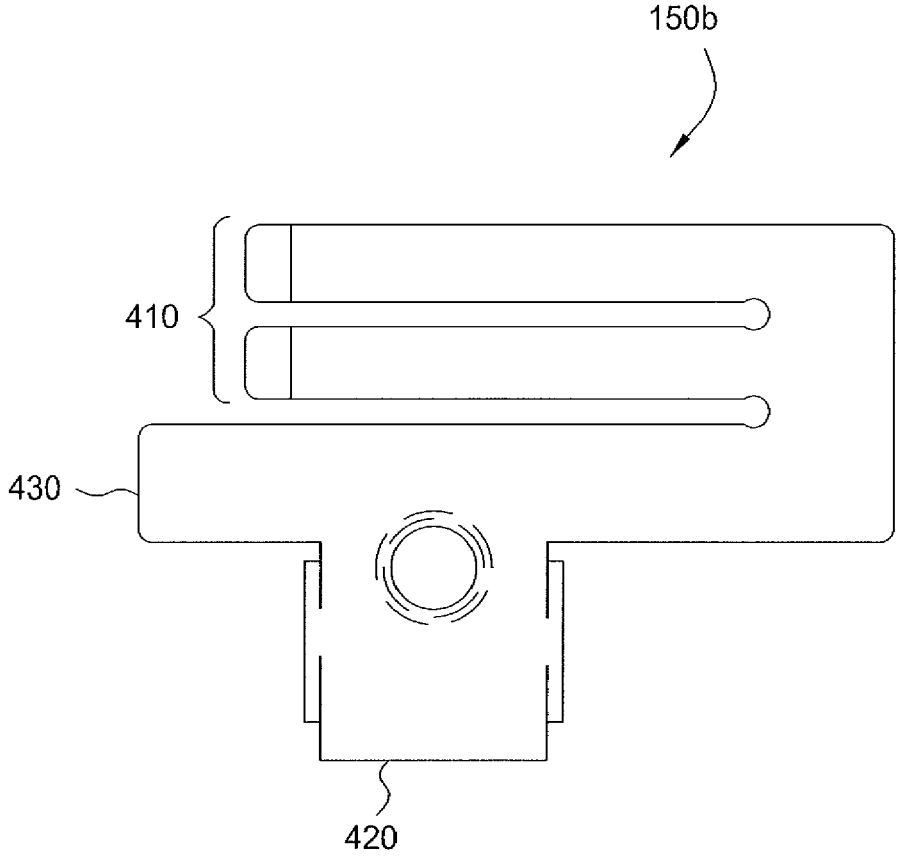
FIGS. 4A-4B illustrate a second embodiment of a contact of the present invention.
Figure 4B:
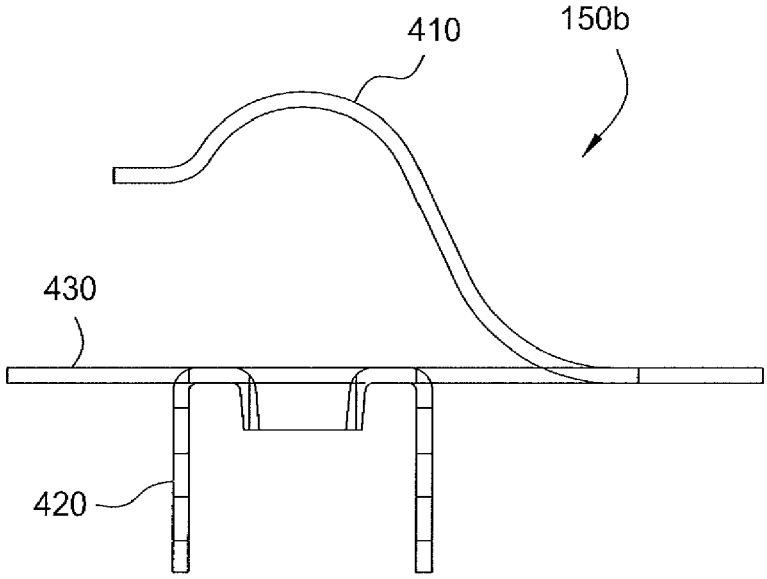

FIGS. 4A-4B illustrate a second embodiment of a contact 150*b* of the present invention. Specifically, FIG. 4A illustrates a front view of contact 150*b* and FIG. 4B illustrates a side view of contact 150*b*. In one embodiment, contact 150*b* comprises a spring loaded portion 410, a base portion 420 and an extension portion 430. In operation, the base portion 420 of contact 150*b* is used to seat and to secure the contact 150*b* into the contact base 220 of the mounting plate 130. The spring loaded portion 410 is used to make contact with a conductive contact located on the circuit board 114 of the notification appliance 110. In operation, one contact 150*b* is deployed in the "negative" contact base 220 and one contact 150*b* is deployed in the "positive" contact base 220. In turn, one contact 150*a* is deployed in the other "positive" contact base 220, such that the extension portion 330 of contact 150*a* in the "positive" contact base 220 is in physical contact with the extension portion 430 of contact 150*a* in the other "positive" contact base 220.

Figure 5:
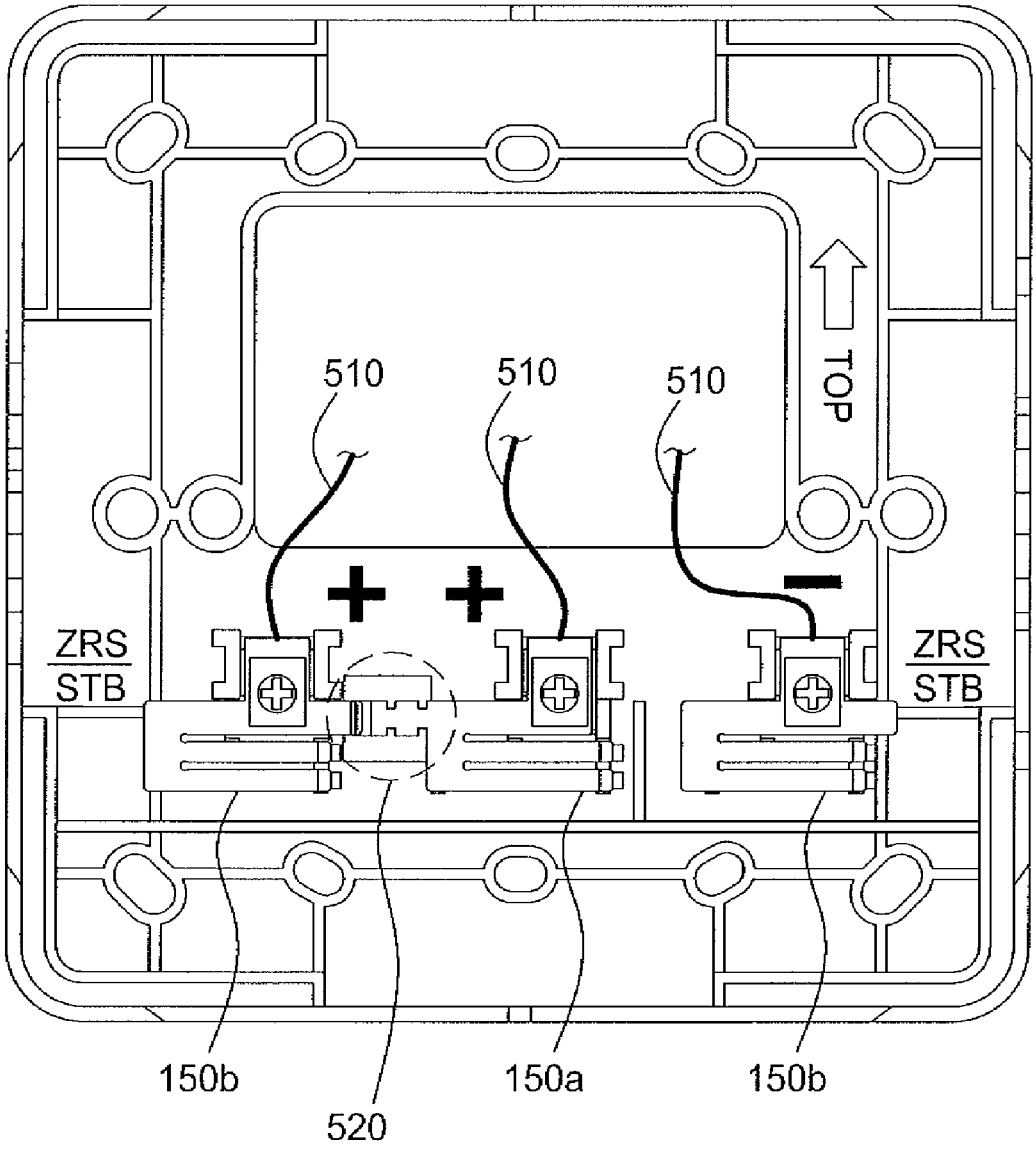
FIG. 5 illustrates a mounting plate assembly having a mounting plate of the present invention with contacts installed on the mounting plate.

FIG. 5 illustrates a mounting plate assembly having a mounting plate 130 of the present invention with contacts 150*a* and 150*b* installed on the mounting plate. In one embodiment, a plurality of leads 510 is coupled to the contacts 150*a* and 150*b*. As shown in FIG. 5, contacts 150*a* and 150*b* situated in the "positive" bases are in physical contact with each other at juncture 520. As such, in this initial configuration, the present mounting plate 130 allows a connectivity test to be performed without having to install all the notification appliances of a particular circuit.

Figure 6A:
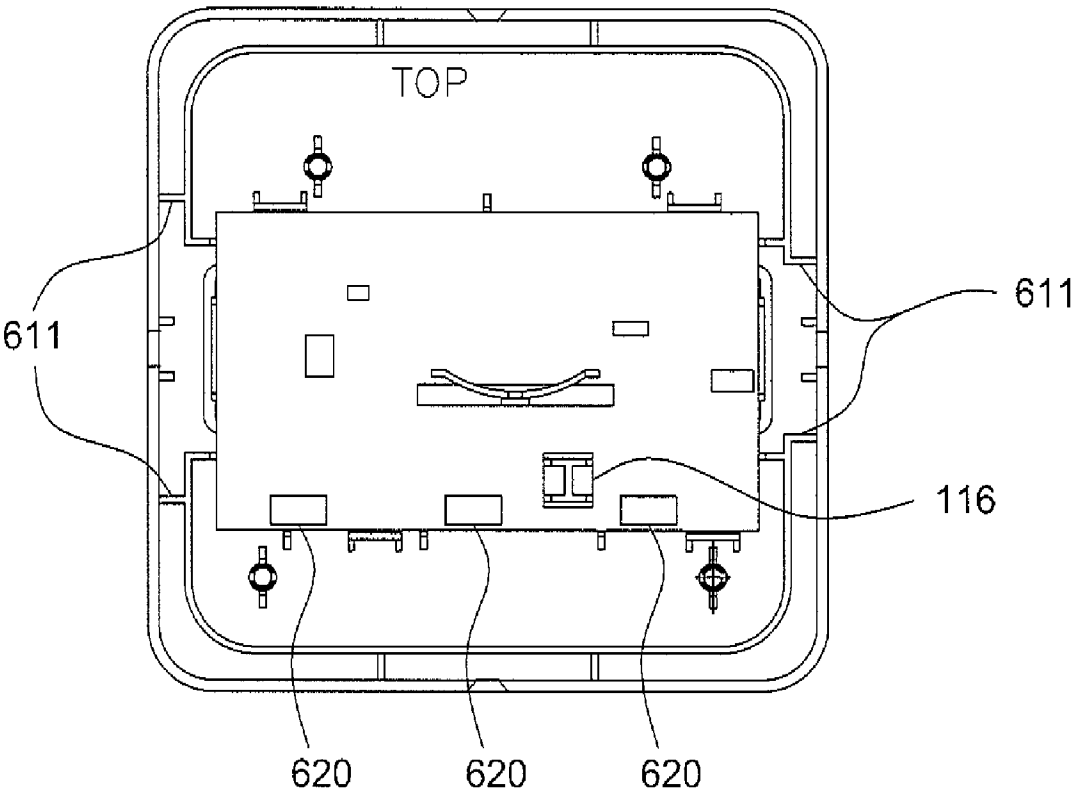
FIGS. 6A-6B illustrates a notification appliance of the present invention.
Figure 6B:
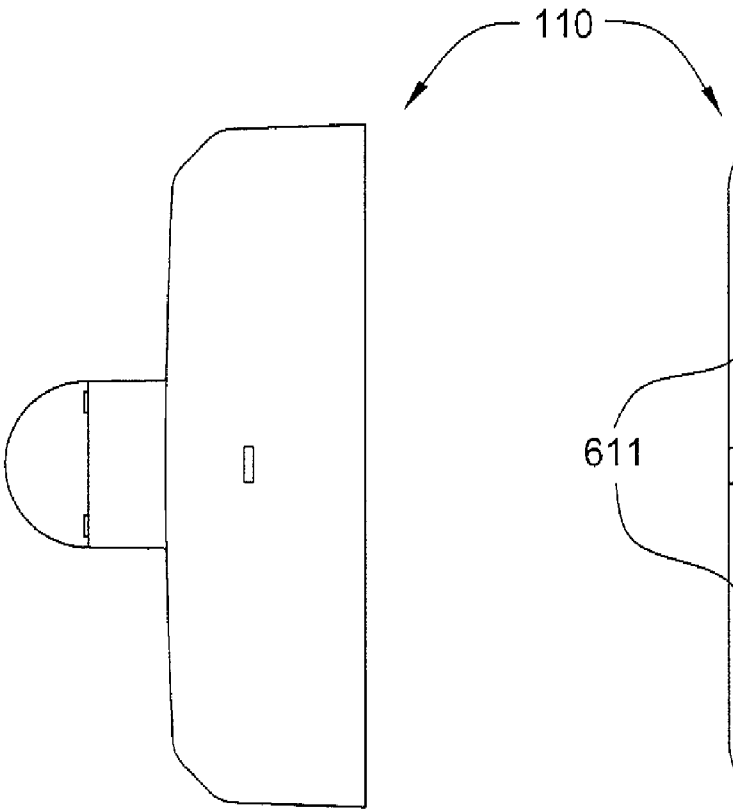

FIGS. 6A-6B illustrate a notification appliance 110 of the present invention. Specifically, FIG. 6A illustrates a front view of the notification appliance 110 and FIG. 6B illustrates a side view of the notification appliance 110. In operation, the notification appliance 110 carries a circuit board 114 containing the audible and/or visible alarm circuitry. In one embodiment, the circuit board 114 contains a plurality of conductive contact points 620 (or broadly contacts) that are specifically located on the circuit board such that when the notification appliance 110 is coupled to the mounting plate 130, the conductive contact points 620 will press upon the spring loaded contacts 150*a* and 150*b* of the mounting plate 130.

Furthermore, notification appliance 110 contains a push rod 116 such that when the notification appliance 110 is coupled to the mounting plate 130, the push rod 116 will impact the contact 150*a* at the juncture 520, i.e., a force is applied to the extension section of contact 150*a*. More specifically, the push rod 116 will cause the contact 150*a* and contact 150*b* to separate from each other, thereby severing the connectivity between the two contacts 150*a* and 150*b*. More specifically, the push rod 116 is designed with a specific length such that when it engages contact 150*a*, the extension section 330 will be deformed to such a state that it will not be resettable to its original state. For example, the extension section 330 can be severely bent from its original shape or it may even break away at the perforated points. This non-resettable aspect of contact 150*a* provides the additional safeguard of detecting a missing notification appliance if it is removed from a circuit.

It should be noted that although one push rod is shown, the present invention is not so limited. For example, if there are multiple junctures where more than one set of contacts have connectivity, then a plurality of push rods can be employed on the notification appliance.

Although various embodiments which incorporate the teachings of the present invention have been shown and described in detail herein, those skilled in the art can readily devise many other varied embodiments that still incorporate these teachings.

What is claimed is:

1. A mounting plate for mounting a notification appliance, comprising:

a first contact coupled to said mounting plate for receiving a first lead; and a second contact coupled to said mounting plate for receiving a second lead, where said first contact and said second contact are in non-resettable physical contact with each via a mechanism that is formed integrally with at least one of the first contact and the second contact.

2. The mounting plate of claim 1, wherein the mechanism comprises an extension section having at least one perforation.

3. The mounting plate of claim 2, wherein said extension section upon receiving a force causes said extension section to deform and break said non-resettable physical contact.

4. The mounting plate of claim 3, wherein said extension section is unable to return to an original state after said force is applied.

5. The mounting plate of claim 1, wherein said mechanism comprises an extension section that is formed from a different material than a remainder of said at least one of the first contact and the second contact.

6. The mounting plate of claim 5, wherein said extension section upon receiving a force causes said extension section to deform and break said non-resettable physical contact.

7. The mounting plate of claim 6, wherein said extension section is unable to return to an original state after said force is applied.

8. The mounting plate of claim 1, further comprising:

a cover for said notification appliance, said cover having a push rod, where coupling of said notification appliance to said mounting plate causes said push rod to apply a force to said mechanism.

9. The mounting plate of claim 8, wherein coupling of said cover to said mounting plate causes a connectivity between said first contact and said second contact to be severed.

10. The mounting plate of claim 9, wherein coupling of said cover to said plate causes a new connectivity between said first contact and said second contact to be created via a circuitry located on said cover.

11. The mounting plate of claim 10, wherein said circuitry is deployed on a circuit board having a plurality of contact points, where at least two of said plurality of contact points are in physical contact with said first contact and said second contact of said mounting plate when said cover is coupled to said mounting plate.

12. The mounting plate of claim 1, further comprising:

a first contact base for supporting said first contact; and a second contact base for supporting said second contact, wherein said first contact base and said second contact base are of a same electrical polarity.

13. The mounting plate of claim 12, wherein said electrical polarity is positive.

14. A notification appliance assembly, comprising:

a notification appliance;

a cover having a push rod, coupled to the notification appliance; and a mounting plate having at least a first contact and a second contact coupled thereto for receiving a first lead and a second lead, where said first contact and said second contact are in non-resettable physical contact with each other via a mechanism that is formed integrally with at least one of the first contact and the second contact.

15. The notification appliance assembly of claim 14, wherein said mechanism comprises an extension section having at least one perforation.

16. The notification appliance assembly of claim 14, wherein said mechanism comprises an extension section that is formed from a different material than a remainder of said at least one of the first contact and the second contact.

17. The notification appliance assembly of claim 14, where coupling of said notification appliance to said mounting plate causes said push rod to apply a force to said mechanism.

18. The notification appliance assembly of claim 17, wherein coupling of said cover to said mounting plate causes a connectivity between said first contact and said second contact to be severed, and wherein coupling of said cover to said mounting plate causes a new connectivity between said first contact and said second contact to be created via a circuitry located on said cover.

19. The notification appliance assembly of claim 14, wherein the mounting plate further comprises:

a first contact base for supporting said first contact; and a second contact base for supporting said second contact, wherein said first contact base and said second contact base are of a same electrical polarity.

20. A mounting plate for mounting a notification appliance, comprising:

a first contact deployed in a first contact base of said mounting plate for receiving a first lead; and a second contact deployed in a first contact base of said mounting plate for receiving a second lead, said second contact being in non-resettable physical contact with said first contact, wherein said first contact base and said second contact base are of a same electrical polarity.

* * * * *